US005958868A

United States Patent [19]

Pi Subirana et al.

[11] Patent Number: 5,958,868

[45] Date of Patent: Sep. 28, 1999

[54] PROCESS FOR PRODUCING AQUEOUS SURFACTANT CONCENTRATES

[75] Inventors: Rafael Pi Subirana, Granollers; Nuria Bonastre Gilabert, Barberá del Vallès; Ester Prat Queralt, Alella; Joaquim Bigorra Llosas, Sabadell, all of Spain

[73] Assignee: Henkel Kommanditgesellschaft auf Aktien, Duesseldorf, Germany

[21] Appl. No.: 08/930,746

[22] PCT Filed: Mar. 21, 1996

[86] PCT No.: PCT/EP96/01216

§ 371 Date: Oct. 24, 1997

§ 102(e) Date: Oct. 24, 1997

[87] PCT Pub. No.: WO96/30477

PCT Pub. Date: Oct. 3, 1996

[30] Foreign Application Priority Data

Mar. 30, 1995 [DE] Germany ..... 195 11 670

[51] Int. Cl.[6] ..... C11D 3/22; C11D 3/32; C11D 1/90

[52] U.S. Cl. ..... 510/470; 510/119; 510/123; 510/130; 510/235; 510/237; 510/470; 510/477; 510/490; 510/502

[58] Field of Search ..... 510/119, 123, 510/130, 235, 237, 470, 477, 490, 502

[56] References Cited

U.S. PATENT DOCUMENTS

| | | | |
|---|---|---|---|
| 1,985,424 | 12/1934 | Piggott | 260/124 |
| 2,016,962 | 10/1935 | Flint et al. | 260/127 |
| 2,703,798 | 3/1955 | Schwartz | 260/211 |
| 5,286,406 | 2/1994 | Scholz et al. | 252/174.17 |
| 5,374,716 | 12/1994 | Biermann et al. | 536/18.6 |
| 5,449,763 | 9/1995 | Wulff et al. | 536/18.6 |
| 5,474,710 | 12/1995 | Ofosu-Asanta et al. | 252/352 |
| 5,476,614 | 12/1995 | Adamy et al. | 252/544 |
| 5,489,393 | 2/1996 | Connor et al. | 252/134 |
| 5,512,699 | 4/1996 | Connor et al. | 564/153 |
| 5,514,369 | 5/1996 | Salka et al. | 424/70.1 |
| 5,540,853 | 7/1996 | Trinh et al. | 510/101 |
| 5,545,354 | 8/1996 | Ofosu-Asanteet al. | 510/237 |
| 5,576,425 | 11/1996 | Hill et al. | 536/18.6 |
| 5,578,560 | 11/1996 | Giesen et al. | 510/237 |
| 5,580,849 | 12/1996 | Dyet et al. | 510/427 |
| 5,614,180 | 3/1997 | Chung | 424/70.19 |
| 5,616,781 | 4/1997 | Sajic et al. | 510/221 |
| 5,646,100 | 7/1997 | Haugk et al. | 510/131 |

FOREIGN PATENT DOCUMENTS

| | | |
|---|---|---|
| 0 301 298 | 2/1989 | European Pat. Off. . |
| 40 09 616 | 10/1991 | Germany . |
| 42 34 487 | 4/1994 | Germany . |
| 44 14 696 | 9/1994 | Germany . |
| 43 11 114 | 10/1994 | Germany . |
| WO90/03977 | 4/1990 | WIPO . |
| WO91/04313 | 4/1991 | WIPO . |
| WO92/06984 | 4/1992 | WIPO . |
| 93/25650 | 12/1993 | WIPO . |
| WO93/25650 | 12/1993 | WIPO . |
| 94/24248 | 10/1994 | WIPO . |
| WO94/24248 | 10/1994 | WIPO . |
| WO95/04592 | 2/1995 | WIPO . |

OTHER PUBLICATIONS

Skin Care Forum 1 (Oct. 1992).
Seifen–Öle–Fette–Wachse 118:894 (1992).
Seifen–Öle–Fette–Wachse 118:905 (1992).
Tens. Surf. Det. 25:8 (1988).
Seifen–Öle–Fette–Wachse 108:373 (1982).
HAPPI 70 (Nov. 1986).
Tens. Det. 23:309 (1986).
Soap Cosm. Chem. Spec. 46 (Apr. 1990).
Euro. Cosm. 1:14 (1994).

*Primary Examiner*—Yogendra N. Gupta
*Assistant Examiner*—Charles Boyer
*Attorney, Agent, or Firm*—Ernest G. Szoke; Wayne C. Jaeschke; Glenn E.J. Murphy

[57] ABSTRACT

The invention concerns aqueous surfactant concentrates having a solids content of between 35 and 65 wt % and containing (a1) alkyl oligoglycosides and/or alkenyl oligoglycosides; and/or (a2) fatty acid N-alkylpolyhydroxy alkylamides; and (b) betaine, in weight ratios of (a):(b) of between 10:90 and 90:10; wherein the pH of these concentrates is between 3.5 and 6.5.

9 Claims, No Drawings

PROCESS FOR PRODUCING AQUEOUS SURFACTANT CONCENTRATES

FIELD OF THE INVENTION

This invention relates to a process for the production of aqueous surfactant concentrates containing selected sugar surfactants and betaines which are distinguished by improved performance properties.

DISCUSSION OF THE RELATED ART

Sugar surfactants, such as for example alkyl oligoglycosides and, more particularly, alkyl oligoglucosides, are nonionic surfactants which are acquiring increasing significance by virtue of their excellent detergent properties and their high ecotoxicological compatibility. The production and use of these substances have been described just recently in a number of synoptic articles, of which the articles by H. Hensen in Skin Care Forum, 1, (October 1992), D. Balzer and N. Ripke in Seifen-Öle-Fette-Wachse 118, 894 (1992) and B. Brancq in Seifen-Öle-Fette-Wachse 118, 905 (1992) are cited as examples. The same applies to a second group of sugar surfactants, namely fatty acid-N-alkyl polyhydroxyalkylamides and preferably fatty acid-N-alkyl glucamides.

Various binary mixtures of sugar surfactants of the type mentioned with other surfactants are known from the prior art. Among these surfactant compounds, combinations of sugar surfactants, more particularly alkyl oligoglucosides, with betaines occupy a special position because foaming and cleaning power and also skin-cosmetic compatibility are improved over a broad molar fraction range. For example, German patent application DE-A1 42 34 487 (Henkel) describes a manual dishwashing detergent containing fatty alcohol sulfates and fatty alcohol ether sulfates in addition to alkyl glucosides and betaines. According to the teaching of DE-A1 43 11 114 (Henkel), mixtures of alkyl glucosides, betaines and selected fatty alcohol polyglycol ethers may be used for the same purpose. Finally, DE-A1 40 09 616 (Henkel) describes liquid body-are formulations containing protein fatty acid condensates in addition to alkyl glucosides and betaines.

However, all the known formulations are more or less dilute aqueous solutions whereas the objective of any manufacturer of alkyl glucoside/betaine mixtures must be to make highly concentrated products which afford distinct advantages in regard to storage. Unfortunately, the production of corresponding concentrates is attended by a number of disadvantages: mixtures of alkyl glucosides and betaines which are generally alkaline from their production are viscous and often cloudy at solids contents of 40 to 60% by weight. In addition, their stability in storage is not always satisfactory, i.e. their viscosity can continue to increase with time through the formation of liquid crystalline gel phases and/or the products undergo crystallization. This naturally leads to a very considerable reduction in the economic value of corresponding concentrates.

Accordingly, the complex problem addressed by the present invention was to provide a process for the production of binary surfactant concentrates which would be free from the disadvantages mentioned above.

DESCRIPTION OF THE INVENTION

The present invention relates to a process for the production of water-containing surfactant concentrates with a solids content of 35 to 65% by weight and preferably 40 to 60% by weight, containing (a1) alkyl and/or alkenyl oligoglycosides and/or (a2) fatty acid-N-alkyl polyhydroxyalkylamides and (b) betaines in a ratio by weight of (a) to (b) of 10:90 to 90:10, characterized in that the concentrates are adjusted to a pH value of 3.5 to 6 and preferably 4 to 6.

It has surprisingly been found that mixtures of sugar surfactants and betaines, which are normally viscous and cloudy at alkaline pH values, readily become low in viscosity and clear when the pH value of the mixtures is reduced to the acidic range. This measure also has a positive effect on the stability of the products in storage, i.e. the concentrates show a constant low viscosity, even in the event of prolonged storage, and have relatively little tendency towards crystallization. The present invention also includes the observation that viscous surfactant concentrates can be reduced in their viscosity and clouding can be eliminated by subsequent adjustment of the pH value.

Alkyl and/or Alkenyl Oligoglycosides

Alkyl and alkenyl oligoglycosides are known substances which correspond to general formula (I):

$$R^1O\text{-}(G)_p \qquad (I)$$

where $R^1$ is an alkyl and/or alkenyl radical containing 4 to 22 carbon atoms, G is a sugar unit containing 5 or 6 carbon atoms and p is a number of 1 to 10, and which may be obtained by the relevant methods of preparative organic chemistry. EP-A-1-0 301 298 and WO 90/03977 are cited as representative of the extensive literature available on this subject.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (I) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and or alkenyl oligoglycosides having a degree of oligomerization of less than 1.7 and, more particularly, between 1.2 and 1.4 are preferred from the applicational point of view.

The alkyl or alkenyl radical $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ cocofatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred.

In addition, the alkyl or alkenyl radical $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and technical mixtures thereof which may be obtained as described above. Alkyl oligoglucosides based on hydrogenated $C_{12/14}$ cocofatty alcohol having a DP of 1 to 3 are preferred.

Fatty acid-N-alkyl polyhydroxyalkylamides

Fatty acid-N-alkyl polyhydroxyalkylamides correspond to formula (II):

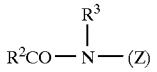

(II)

in which $R^2CO$ is an aliphatic acyl radical containing 6 to 22 carbon atoms, $R^3$ is hydrogen, an alkyl or hydroxyalkyl radical containing 1 to 4 carbon atoms and [Z] is a linear or branched polyhydroxyalkyl radical containing 3 to 12 carbon atoms and 3 to 10 hydroxyl groups.

The fatty acid-N-alkyl polyhydroxyalkylamides are known compounds which may normally be obtained by reductive amination of a reducing sugar with ammonia, an alkylamine or an alkanolamine and subsequent acylation with a fatty acid, a fatty acid alkyl ester or a fatty acid chloride. Processes for their production are described in U.S. Pat. No. 1,985,424, in U.S. Pat. No. 2,016,962 and in U.S. Pat. No. 2,703,798 and in International patent application WO 92/06984. An overview of this subject by H. Kelkenberg can be found in Tens. Surf. Det. 25, 8 (1988).

The fatty acid-N-alkyl polyhydroxyalkylamides are preferably derived from reducing sugars containing 5 or 6 carbon atoms, more particularly from glucose. Accordingly, the preferred fatty acid-N-alkyl polyhydroxyalkylamides are fatty acid-N-alkyl glucamides which correspond to formula (III):

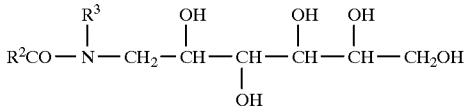

(III)

Preferred fatty acid-N-alkyl polyhydroxyalkylamides are glucamides corresponding to formula (III) in which $R^3$ is hydrogen or an alkyl group and $R^2CO$ represents the acyl component of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid or technical mixtures thereof. Fatty acid-N-alkyl glucamides (III) obtained by reductive amination of glucose with methylamine and subsequent acylation with lauric acid or $C_{12/14}$ cocofatty acid or a corresponding derivative are particularly preferred. In addition, the polyhydroxyalkylamides may also be derived from maltose and palatinose.

Betaines

Betaines are known surfactants which are mainly produced by carboxyalkylation, preferably carboxymethylation, of aminic compounds. The starting materials are preferably condensed with halo carboxylic acids or salts thereof, more particularly with sodium chloroacetate, 1 mole of salt being formed per mole of betaine. The addition of unsaturated carboxylic acids, such as acrylic acid for example, is also possible. Information on the nomenclature and, in particular, the difference between betaines and "true" amphoteric surfactants can be found in the Article by U, Ploog in Seifen-Öe-Fette-Wachse, 198, 373 (1982). Further information on this subject can be found, for example, in A. O'Lennick et al., HAPPI, November 70 (1986), in S. Holzman et al., Tens. Det. 23, 309 (1986), in R. Bibo et al. Soap Cosm. Chem. Spec. April 46 (1990) and in P. Ellis et al., Euro Cosm. 1, 14 (1994).

Examples of suitable betaines are the carboxyalkylation products of secondary and, in particular, tertiary amines which correspond to formula (IV):

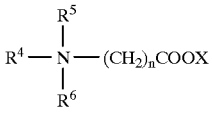

(IV)

in which $R^4$ represents alkyl and/or alkenyl radicals containing 6 to 22 carbon atoms, $R^5$ is hydrogen or alkyl radicals containing 1 to 4 carbon atoms, $R^6$ represents alkyl radicals containing 1 to 4 carbon atoms, n is a number of 1 to 6 and X is an alkali metal and/or alkaline earth metal or ammonium.

Typical examples are the carboxymethylation products of hexyl methylamine, hexyl dimethylamine, octyl dimethyl amine, decyl dimethylamine, dodecyl methylamine, dodecyl dimethylamine, dodecyl ethyl methylamine, $C_{12/14}$ cocoalkyl dimethylamine, myristyl dimethylamine, cetyl dimethylamine, stearyl dimethylamine, stearyl ethyl methylamine, oleyl dimethylamine, $C_{16/18}$ tallow alkyl dimethylamine and technical mixtures thereof.

Also suitable are carboxyalkylation products of amidoamines corresponding to formula (V):

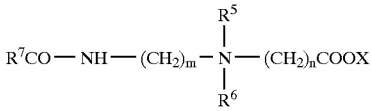

(V)

in which $R^7CO$ is an aliphatic acyl radical containing 6 to 22 carbon atoms and 0 or 1 to 3 double bonds, m is a number of 1 to 3 and $R^5$, $R^6$, n and X are as defined above.

Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethyl aminoethylamine, N,N-dimethyl aminopropylamine, N,N-diethyl aminoethylamine and N,N-diethyl aminopropylamine which are condensed with sodium chloroacetate. It is preferred to use a condensation product of $C_{8/18}$ cocofatty acid N,N-dimethyl aminopropylamide with sodium chloroacetate.

Other suitable starting materials for the betaines to be used in accordance with the invention are imidazolines corresponding to formula (VI):

(VI)

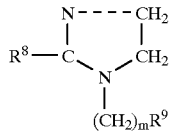

in which $R^8$ is an alkyl radical containing 5 to 21 carbon atoms, $R^9$ is a hydroxyl group, an $OCOR^8$ or $NHCOR^8$ group and m=2 or 3. These substances are also known substances which may be obtained, for example, by cyclizing condensation of 1 or 2 moles of fatty acid with polyfunctional amines such as, for example, aminoethyl ethanolamine, (AEEA) or diethylene triamine. The corresponding carboxyalkylation products are mixtures of different open-chain betaines.

Typical examples are condensation products of the abovementioned fatty acids with AEEA, preferably imidazolines based on lauric acid or, again, $C_{12/14}$ cocofatty acid which are subsequently betainized with sodium chloroacetate.

Surfactant Concentrates

The surfactant concentrates are aqueous solutions or pastes having a solids content of 40 to 60% by weight and preferably 45 to 55% by weight. Components (a) and (b) may be present in the concentrates in a ratio by weight of 90:10 to 10:90, preferably 80:20 to 20:80 and, more preferably, 60:40 to 40:60.

The surfactant compounds may be produced in various ways. For example, dilute solutions of the sugar surfactants and the betaines may be mixed and subsequently concentrated. However, it is better to mix the concentrates, thereby eliminating the need for the complicated removal of water from the mixtures. Finally, the concentrates are directly obtained in the production of the betaines providing the quaternization of the tertiary amines on which the betaines are based is carried out in the presence of the water-containing sugar surfactants as solvent. The time at which the pH value is adjusted is not critical. It is even possible subsequently to convert viscous, cloudy concentrates into products of satisfactory performance. The pH value is preferably adjusted by addition of mineral acids such as, for example, hydrochloric acid, sulfuric acid or, preferably, phosphoric acid or organic acids, such as lactic acid, citric acid and the like. $C_{8-18}$ and preferably $C_{12-14}$ fatty acids liquid at room temperature, such as lauric acid or oleic acid for example, may also be used for the same purpose.

Commercial Applications

By reducing the pH value, it is possible over a broad molar fraction range to produce concentrates of sugar surfactants and betaines which have a low viscosity favorable for handling, which are clear and which show increased stability in storage. The concentrates are suitable for the production of surface-active formulations, such as in particular manual dishwashing detergents and hair shampoos.

The following Examples are intended to illustrate the invention without limiting it in any way.

EXAMPLES

| I. | Surfactants used |
|---|---|
| A1) | $C_{8/10}$ alkyl oligoglucoside (Plantaren ® APG 225) |
| A2) | $C_{12/16}$ alkyl oligoglucoside (Plantaren ® APG 1200) |
| A3) | $C_{8/16}$ alkyl oligoglucoside (Plantaren ® APG 2000) |
| A4) | Mixture of A1 and A3 (60:40 parts by weight) |
| A5) | Mixture of A1 and A3 (80:20 parts by weight) |
| A6) | Mixture of A1 and A3 (75:25 parts by weight) |
| A7) | Mixture of A1 and A3 (50:50 parts by weight) |
| A8) | Mixture of A1 and A3 (43:57 parts by weight) |
| A9) | Cocofatty acid N-methyl glucamide |
| B1) | Betaine based on fatty acid aminoamide (Dehyton ® PK 45) |
| B2) | Betaine based on tertiary amine (Dehyton ® AB 30) |

II. Performance Test Results

The mixtures of Examples 1 to 13 were adjusted to a solids content of 50% by weight and to a pH value of 4 to 6. The viscosity of the products was determined by the Brookfield method (20° C., 10 r.p.m., spindle 2) both immediately and after storage for 6 months at 10° C. Appearance was visually evaluated after storage for 10 days. The products of Comparison Examples C1 to C4 were treated in the same way, but adjusted to an alkaline pH value. The results are set out in Table 1 (percentages as % by weight).

TABLE 1

Viscosity measurements and storage tests

| | | | | SC | | Vis. [mPa · s] | | |
|---|---|---|---|---|---|---|---|---|
| Ex. | A | B | A:B | % | pH | 1 h | 6 m | Prod. |
| 1 | A1 | B1 | 25:75 | 51 | 4.2 | 500 | 550 | Clear |
| 2 | A1 | B1 | 50:50 | 56 | 5.6 | 2700 | 2800 | Clear |
| 3 | A1 | B1 | 75:25 | 62 | 5.7 | 6150 | 6175 | Clear |
| 4 | A2 | B2 | 50:50 | 50 | 5.0 | 3000 | 3100 | Clear |
| 5 | A3 | B1 | 25:75 | 40 | 5.0 | 250 | 275 | Clear |
| 6 | A3 | B1 | 50:50 | 44 | 4.7 | 1500 | 1550 | Clear |
| 7 | A3 | B1 | 75:25 | 47 | 4.2 | 1200 | 1300 | Clear |
| 8 | A4 | B1 | 57:43 | 54 | 5.1 | 3100 | 3200 | Clear |
| 9 | A5 | B1 | 59:41 | 55 | 5.4 | 3000 | 3100 | Clear |
| 10 | A6 | B1 | 48:52 | 53 | 5.5 | 2400 | 2500 | Clear |
| 11 | A7 | B1 | 67:33 | 55 | 5.1 | 3100 | 3200 | Clear |
| 12 | AB | B1 | 75:25 | 56 | 5.1 | 2900 | 3000 | Clear |
| 13 | A9 | B1 | 50:50 | 50 | 5.0 | 1200 | 1250 | Clear |
| C1 | A1 | B1 | 50:50 | 56 | 10.8 | 6000 | — | Cloudy |
| C2 | A2 | B2 | 50:50 | 50 | 9.5 | 7500 | — | Cloudy |
| C3 | A3 | B1 | 75:25 | 47 | 11.0 | 1700 | — | Cloudy |
| C4 | A3 | B1 | 50:50 | 48 | 10.0 | 6600 | — | Cloudy |

Legend:
SC = Solids content
Vis. = Viscosity
Prod. = Appearance of the product

The products obtained by the process according to the invention show a constant, low viscosity and remain clear, even after storage for 6 months. By contrast the comparison products accumulate in the form of viscous, cloudy mixtures during their production and either crystallize or continue to thicken in storage.

What is claimed is:

1. A process for preparing a stable aqueous surfactant concentrate comprising combining in an aqueous medium a sugar surfactant comprising an alkyl or alkenyl oligoglycoside or a fatty acid-N-alkyl polyhydroxyalkylamide and a betaine, wherein the sugar surfactant and betaine together comprise 40% to 65% by weight of the concentrate and are present in the concentrate in a weight ratio of 10:90 to 90:10, and adjusted the pH of the aqueous medium to 3.5 to 6.5.

2. A process according to claim 1, wherein the sugar surfactant and the betaine together comprise 40% to 60% by weight of the concentrate.

3. A process according to claim 1, wherein the sugar surfactant and betaine are present in the concentrate in a weight ratio of 80:20 to 20:80.

4. A process according to claim 3, wherein the sugar surfactant and the betaine are present in the concentrate in a weight ratio of 60:40 to 40:60.

5. A process according to claim 1, wherein the pH is adjusted by the addition of an acid selected from the group consisting of hydrochloric acid, sulfuric acid, phosphoric acid, lactic acid, citric acid, lauric acid, and oleic acid.

6. A process according to claim 1, wherein the oligoglycoside is a compound of the formula (I):

$$R^1O\text{-}(G)_p \qquad \text{(I)}$$

wherein $R^1$ is $C_4$ to $C_{22}$ alkyl or alkenyl, G is a sugar unit having 5 or 6 carbon atoms, and p is a number of 1 to 10.

7. A process according to claim 1, wherein the fatty acid-N-alkylpolyhydroxyalkylamide is a compound of formula (II):

$$R^2CO-\overset{\overset{\displaystyle R^3}{|}}{N}-(Z) \qquad \text{(II)}$$

wherein $R^2CO$ is $C_6$ to $C_{22}$ aliphatic acyl, $R^3$ is hydrogen, $C_1$ to $C_4$ alkyl, or $C_1$ to $C_4$ hydroxyalkyl, and Z is linear or branched $C_3$ to $C_{10}$ polyhydroxyalkyl having 3 to 10 hydroxyl groups.

8. A process according to claim 1, wherein the betaine is a compound of the formula (IV):

$$R^4-\overset{\overset{\displaystyle R^5}{|}}{\underset{\underset{\displaystyle R^6}{|}}{N}}-(CH_2)_nCOOX \qquad \text{(IV)}$$

wherein $R^4$ is $C_6$ to $C_{22}$ alkyl or alkenyl, $R^5$ is hydrogen or $C_1$ to $C_4$ alkyl, $R^6$ is $C_1$ to $C_4$ alkyl, n is a number of 1 to 6, and X is alkali metal, alkaline earth metal, or ammonium.

9. A process according to claim 1, wherein the betaine is a compound of the formula (V):

$$R^7CO-NH-(CH_2)_m-\overset{\overset{\displaystyle R^5}{|}}{\underset{\underset{\displaystyle R^6}{|}}{N}}-(CH_2)_nCOOX \qquad \text{(V)}$$

wherein $R^7CO$ is $C_6$ to $C_{22}$ aliphatic acyl having 0 to 3 double bonds, $R^5$ is hydrogen or $C_1$ to $C_4$ alkyl, $R^6$ is $C_1$ to $C_4$ alkyl, m is a number of 1 to 3, n is a number of 1 to 6, and X is alkali metal, alkaline earth metal, or ammonium.

* * * * *